United States Patent [19]

Hilbert et al.

[11] 4,159,398

[45] Jun. 26, 1979

[54] STEREO PRESENCE SIGNAL FOR AN AM STEREO SYSTEM

[75] Inventors: Francis H. Hilbert, Addison; Norman W. Parker, Wheaton, both of Ill.

[73] Assignee: Motorola, Inc., Schaumburg, Ill.

[21] Appl. No.: 837,256

[22] Filed: Sep. 27, 1977

[51] Int. Cl.[2] ..... H04H 5/00

[52] U.S. Cl. ..... 179/1 GS

[58] Field of Search ..... 179/15 BT, 1 GS; 325/36, 60, 456

[56] References Cited

U.S. PATENT DOCUMENTS

| | | | |
|---|---|---|---|
| 3,068,475 | 12/1962 | Avins | 179/15 BT |
| 3,080,453 | 3/1963 | Avins | 179/15 BT |
| 3,534,172 | 10/1970 | Weeda | 179/15 BT |
| 3,823,268 | 7/1974 | Modafferi | 179/15 BT |
| 3,908,090 | 9/1975 | Kahn | 179/15 BT |
| 4,018,994 | 4/1977 | Kahn | 179/15 BT |
| 4,037,057 | 7/1977 | Ogita et al. | 179/15 BT |

*Primary Examiner*—Douglas W. Olms

*Attorney, Agent, or Firm*—Margaret Marsh Parker; James W. Gillman

[57] ABSTRACT

In an AM broadcast transmitter, an infrasonic tone is added to the difference channel of a compatible AM stereo system to provide a stereo presence signal. In a stereophonic receiver, the corrected output of a synchronous detector in the difference signal channel is coupled to an infrasonic detector for control of a mono/stereo mode switch and a stereo presence indicator. When the received signal is weak, the infrasonic tone is effectively stronger, because the phase angle is increased. Since the s/n ratio is proportional to the phase angle, the stereo presence signal is self-adjusting. The mode switch and indicator are enabled for all values of L and R. The infrasonic tone could also be removed from the transmitted signal whenever the difference signal goes above a predetermined level during stereo broadcasting, in which case a comparator at the receiver would enable the mode switch and indicator upon detection of either a difference signal or the infrasonic tone.

10 Claims, 5 Drawing Figures

STEREO PRESENCE SIGNAL FOR AN AM STEREO SYSTEM

BACKGROUND OF THE INVENTION

This invention relates to the field of compatible AM stereo broadcasting and more particularly to a system for differentiating between stereo and monophonic transmission.

In commercial broadcasting, whether AM or FM, it is likely that at any given time, some stations will be broadcasting stereophonic sound and others, monophonic. Also, any one station may, for example, broadcast musical programs stereophonically but "talk shows" or commercials monaurally. Most radio listeners prefer to know the broadcasting mode of a chosen station. More importantly, there are advantages in switching the receiver circuitry to a monophonic mode of operation when no stereo is being received.

In frequency modulated broadcasting, a 19 KHz pilot carrier used for regeneration of the suppressed carrier can also be used to enable a "stereo" indicator, typically a small lamp or LED display. The same signal is used to switch the receiver output circuitry from the monaural mode to a stereophonic mode. In the AM band, however, there is no available channel space for such an additional carrier and any signal used for indicating the presence of stereo or mode switching must be on the main carrier, within a 10 KHz channel assignment.

SUMMARY OF THE INVENTION

It is therefore an object of the present invention to provide in a compatible AM stereo broadcast system a stereo presence signal for detection in a stereo receiver.

It is a particular object to provide such a signal within the normal bandwidth for AM broadcasting.

It is another particular object to provide a signal which can be utilized for mode switching and for stereo presence indication in a receiver.

It is a more particular object to provide such a signal which is self-adjusting when the received carrier level is attenuated.

These and other objects are provided in a system in accordance with the invention and having an infrasonic tone added to the difference signal before modulation on the quadrature carrier. Since the modulated carrier is amplitude limited, then amplitude modulated with the sum signal, the infrasonic tone or stereo presence signal is present in the received signal as phase modulation. The difference signal including the stereo presence signal is detected in a synchronous detector, then the stereo presence signal is amplified and detected in a low frequency detector. The detector output is rectified and utilized to operate a mono/stereo mode switch in the receiver circuitry. It may also be used to enable an indicator such as a lamp. Alternatively, the stereo presence signal may be added to the difference signal channel only when the difference signal is below a set level. In a receiver for this type of signal, the detector output would couple to an OR gate as would the output of a difference signal detector. Detection of either a difference signal or a stereo presence signal would activate the mode switch and indicator. The stereo presence signal is self-adjusting since, when the carrier level is attenuated (as in fading), the angle of modulation of the difference channel increases and the s/n ratio is proportional to the modulation angle.

DETAILED DESCRIPTION OF A PREFERRED EMBODIMENT

Figures 1, 2:
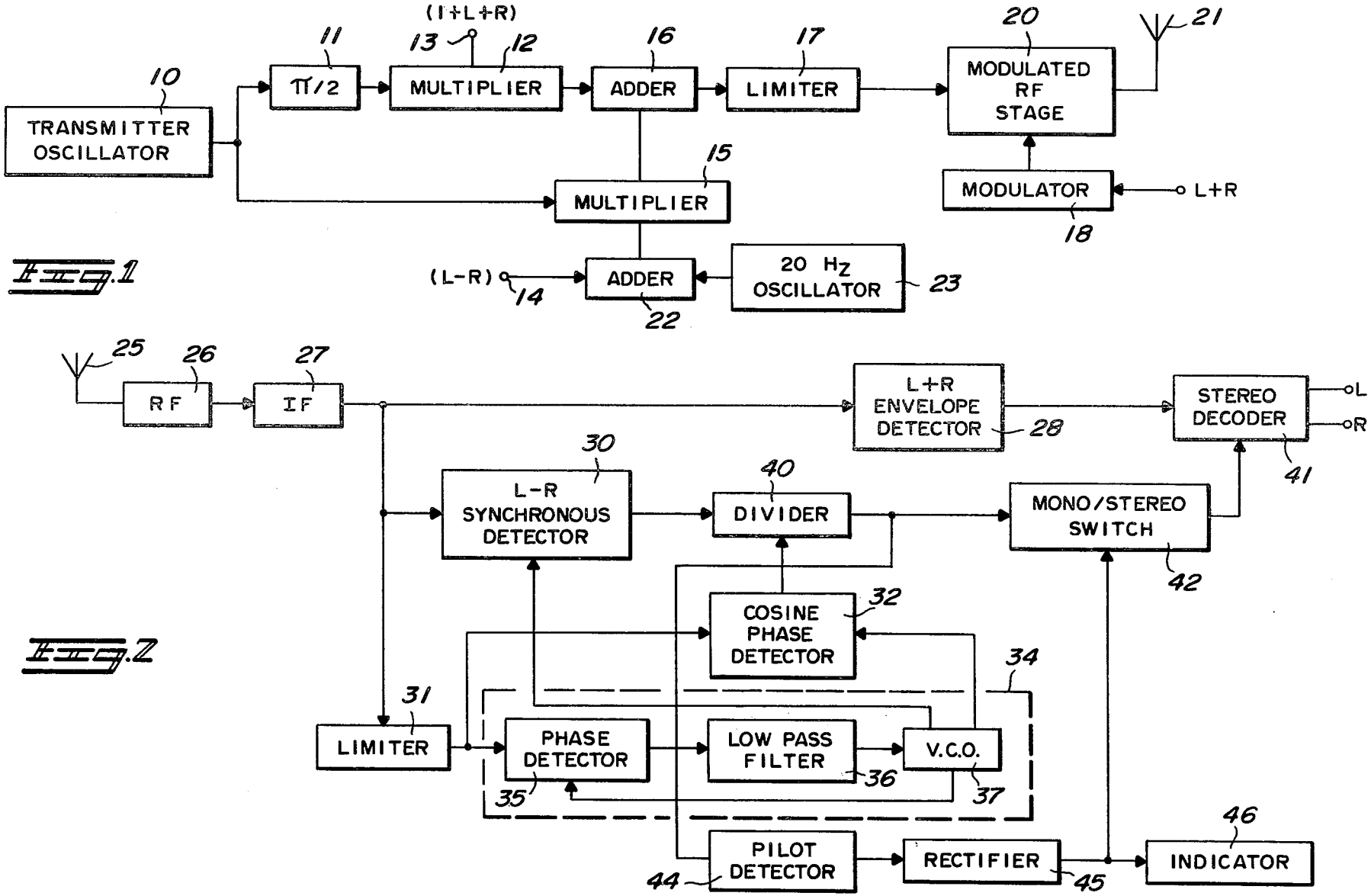
FIG. 1 is a block diagram of a transmitter with an infrasonic tone added in the difference channel.
FIG. 2 is one embodiment of a receiver for receiving the signal of the transmitter of FIG. 1.

The present invention will be best understood in relation to the drawing wherein like parts have like reference numerals throughout.

The block diagram of FIG. 1 is based on a compatible AM stereo transmitter such as is described in detail in co-pending application Ser. No. 674,703, assigned to the same assignee as is the present invention. A source of AM broadcast carrier frequency, such as a crystal-controlled oscillator 10, is phase shifted to provide two carriers in phase quadrature. As is known in the art, this arrangement may be accomplished in any one of several ways: as illustrated, the oscillator output may be split and one signal shifted by 90° in a phase shifter 11. Another possibility is a system which shifts the phase of one signal by +45° and the other by −45° (45° phase shifters not shown). In either case, one carrier signal is modulated in a multiplier 12 by the stereo sum signal plus a DC offset signal (1+L+R) from a stereo source 13. In the above-referenced application, the stereo difference signal (L−R) from another stereo source 14 is coupled to another multiplier 15, and the outputs of the two multipliers 12 and 15 are added in an adder 16. The output of the adder 16 is the carrier, amplitude modulated in quadrature $\sqrt{(1+L+R)^2+(L-R)^2}\cos(\omega_c t+\phi)$ where $\phi$ is arc $\tan(L-R)/(1+L+R)$. This is a satisfactory stereo signal but it cannot be used on the broadcast band since it would not be compatible with monophonic (L+R) receivers. To achieve a compatible signal, the signal is amplitude limited in a limiter 17, leaving only phase modulation, then the carrier is amplitude modulated with the sum signal (L+R) from a modulator 18 in a power output stage 20. The phase and amplitude modulated signal is then transmitted via antenna 21. The broadcast signal, then, is of the form $(1+L+R)\cos(\omega_c t+\phi)$.

To provide a stereo presence signal in accordance with the present invention during stereo transmission only, the difference signal (L−R) is coupled to the multiplier 15 through an adder 22. An infrasonic (20 Hz) oscillator 23 is also coupled to the adder 22 where it is combined with the difference signal. The adder 22 output, coupled to the multiplier 15 for modulating one of the carriers in quadrature, will be (L−R) plus 20 Hz. The remainder of the operation is as described above and as in the above-referenced application. The 20 Hz signal is only present in the phase modulation and does not affect monophonic (L+R) reception.

FIG. 2 shows an embodiment of the invention in a receiver such as is otherwise disclosed fully in a co-pending application, S.N. 837,258, assigned to the same assignee as is the present invention and filed as of even date with the present application. The signal broadcast by the transmitter of FIG. 1 is received at receiver antenna 25 and processed in the customary manner in RF stage 26 and IF stage 27 to provide an intermediate frequency signal. The sum or monophonic signal is recovered from the IF signal in an envelope detector 28. The IF stage output is also coupled to a synchronous detector 30 and a limiter 31: In the limiter 31, amplitude variations are removed and the output carries only the stereo phase modulation which is proportional to $\cos(\omega_c t+\phi)$ where $\phi$ is arc $\tan[(L-R)/(1+L+R)]$. The output of the limiter 31 is coupled to a cosine phase detector 32 which is a multiplier. The output of the limiter 31 is also coupled to a phase locked loop 34, the latter including a phase detector 35, lowpass filter 36 and VCO 37. An output of VCO 37, which is a function of $\sin \omega_c t$, is coupled to the synchronous detector 30 (also a multiplier wherein multiplication of the VCO 37 output and the received signal (with IF carrier) provides a signal $(1+L+R)\cos(\omega_c t+\phi)\sin \omega_c t$ which, disregarding the double frequency term, is $(1+L+R)\sin$ arc $\tan[L-R)/(1+L+R)]$ or $(1+L+R)\sin \phi$ which, it will be seen, is $(L-R) \cos \phi$. A phase shifted output ($\cos \omega_c t$) of VCO 37 (phase shifter not shown) is also coupled to the cosine phase detector 32 in which the two inputs are combined to provide a signal proportional to $\cos \phi$. When this signal and the output of the synchronous detector 30 are processed in a divider 40, the resultant signal is the original difference signal (plus the small 20 Hz stereo presence signal). The difference signal is coupled to a stereo decoder or matrix 41 through a mono/stereo mode switch 42, the functions of which will be described hereinafter. The signal from the divider 40 is also coupled through a pilot tone detector 44 which will amplify and detect the 20 Hz tone. The pilot detector output, rectified in a rectifier 45, is coupled to control the mode switch 42 and also to a stereo indicator 46 which may be a simple lamp or other indicator device. Thus, during stereo transmission the detection of the 20 Hz pilot tone will not only enable a stereo indicator, but will switch the circuit into the stereo mode via the mono/stereo mode switch 42. The mode switch may be any of a number of voltage controlled switches which, when appropriate control signals are applied, opens or closes a circuit therethrough.

Summarizing the system of FIGS. 1 and 2, it will be seen that the stereo presence signal, having been added to the difference signal, has been phase modulated on the broadcast and received carrier. Since $\tan \phi$ is $(L-R+SP)/(1+L+R)$ where SP is the amplitude of the stereo presence signal, the angle of modulation of the stereo presence signal increases as a function of the reciprocal of the amplitude of the monophonic signal. The stereo presence signal is self-adjusting as the angle $\phi$ is effectively increased when the broadcast signal weakens. This provides a better signal to noise ratio since, as is known, the s/n ratio in phase modulation is essentially proportional to $\phi$.

Figure 3:
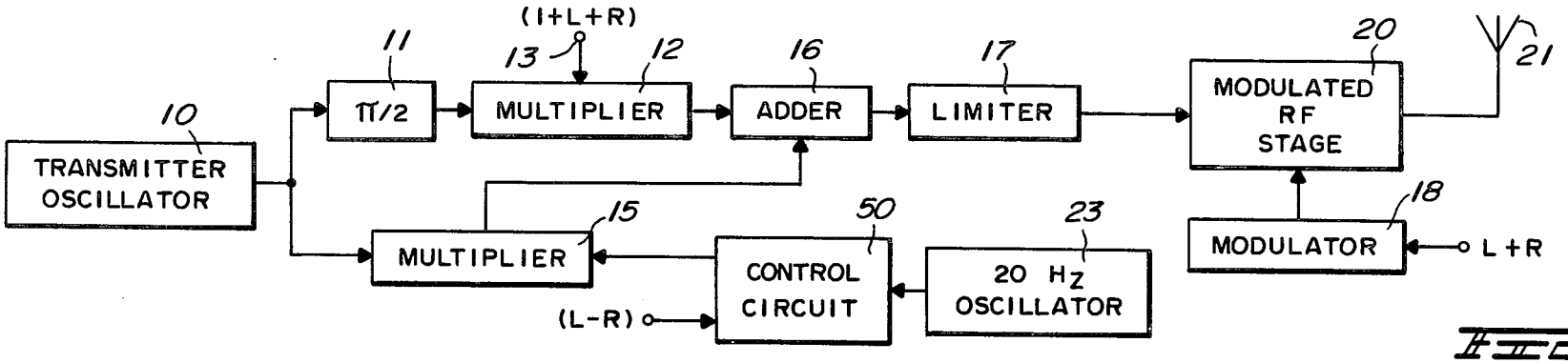
FIG. 3 is a second embodiment of a transmitter providing the infrasonic tone only during a low level difference signal.

In FIG. 3, a transmitter is shown which is similar to the transmitter of FIG. 1 but having the difference signal and infrasonic tone coupled to a control circuit 50 and thence to the multiplier 15. The control circuit 50 functions to couple the difference signal to the multiplier for modulation on the oscillator frequency as long as the difference signal has an amplitude greater than a predetermined level which level may be zero. When the difference signal drops below this threshold, the 20 Hz signal is coupled through to the multiplier 15, thus, either L−R or 20 Hz is always present during stereo mode broadcasting.

Figure 4:
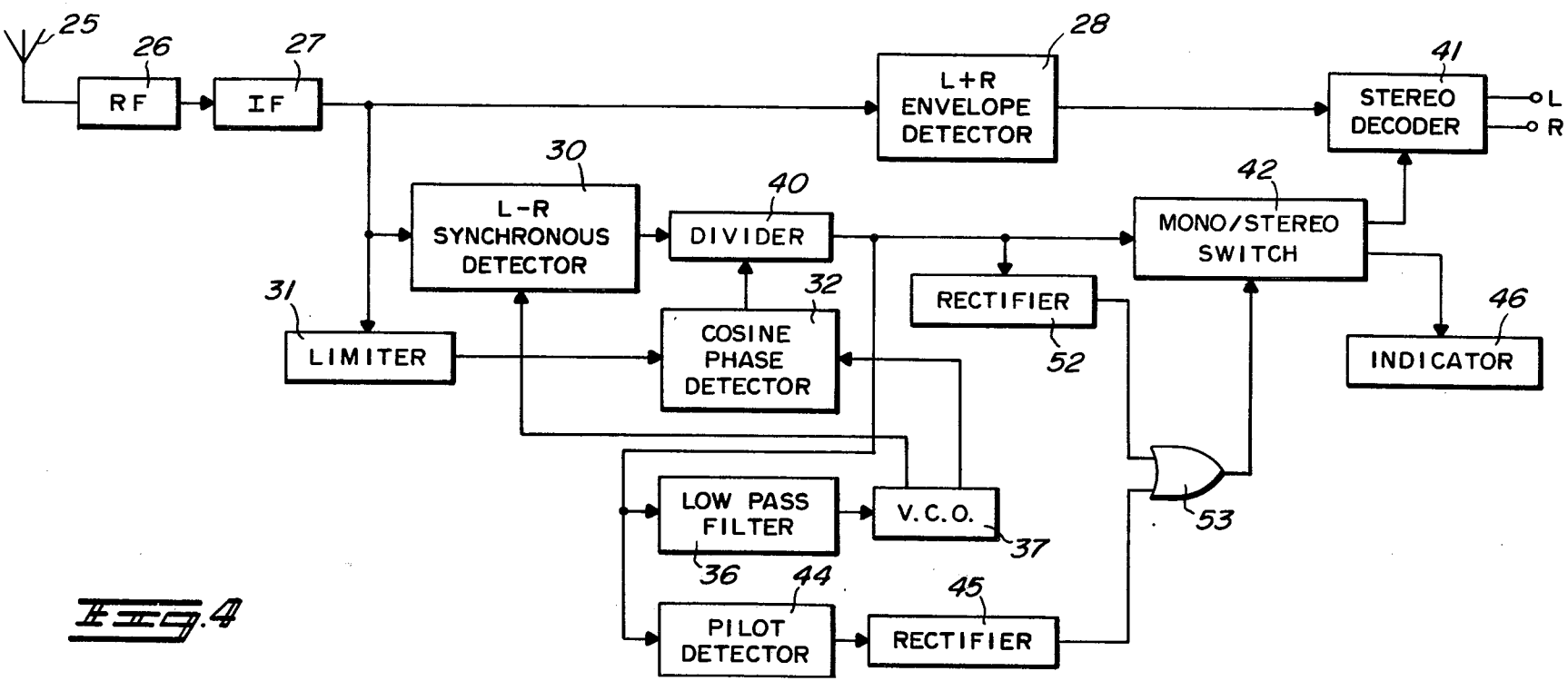
FIG. 4 is a block diagram of a receiver for use with the signal as provided by the transmitter of FIG. 3.

FIG. 4 discloses a receiver similar to the receiver of FIG. 2, but modified to cooperate with the transmitter of FIG. 3. In this embodiment, either the L−R signal or the stereo presence signal will be present in the output of the synchronous detector 30 and the corrected output of divider 40, and each must be separately detected for porper operation. The L−R signal can be detected simply in a rectifier 52 and coupled to an OR gate 53. The infrasonic pilot tone, being of such low frequency, is amplified and detected in the pilot detector 44, rectified in the rectifier 45, and the output coupled to the OR gate 53. The OR gate 53 will therefore provide an output when either the L−R or infrasonic tone is present, and will activate the mono/stereo switch 42 to the stereo mode. The switch 42 output will also activate the indicator 46, but the indicator could be coupled directly to the OR gate 53.

Figure 5:
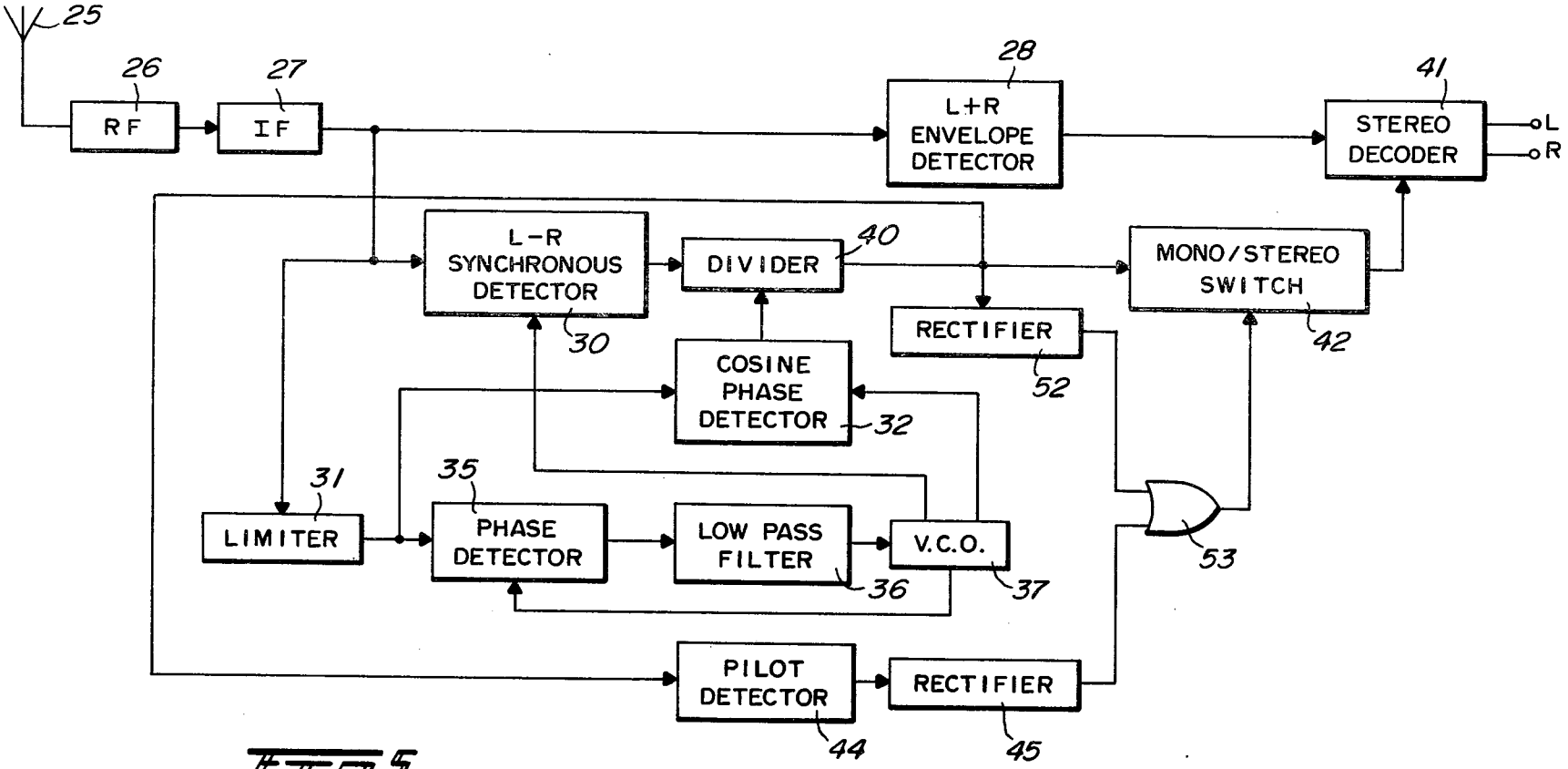
FIG. 5 is a block diagram of another receiver for use with the transmitter of FIG. 3.

FIG. 5 shows a receiver similar to those of FIGS. 2 and 4, and also operative with the signal from transmitter of FIG. 3. Whereas in FIG. 4, the input to the lowpass filter 36 of the phase locked loop 34 (FIG. 2) came from the output of the divider 40, in FIG. 5 the input to the lowpass filter 36 is from the phase detector 35. It will be seen that in either case the output of the VCO 37 will be a function of the phase of the original carrier frequency. In all other respects the receiver of FIG. 5 is similar to that of FIG. 4. It should be noted that the receivers of FIGS. 4 and 5 would also be completely operative with the signals of the transmitter of FIG. 1.

Thus, there has been shown a system and receivers therefor which have an infrasonic stereo presence signal added to the difference channel of a compatible AM stereo signal. This signal is self-adjusting in that when the L+R amplitude modulation on the carrier is reduced, as due to fading, the infrasonic tone is relatively stronger with better signal to noise ratio due to the increase in the angle $\phi$. With this signal, the mode switch and indicator will be enabled for all values of L and R, including L=R and L=R=O. Numerous variations and modifications of the invention are possible and it is intended to cover all such as fall within the spirit and scope of the appended claims.

What is claimed is:

1. A communication system wherein signal information corresponding to first (L) and second (R) intelligence signals is transmitted in quadrature and is compatible for both monophonic and stereophonic operation and further including a stereo presence signal, the transmitted signal having the form $(1+L+R)\cos(\omega_c t+\phi)$ where $\omega_c t$ is a carrier frequency and $\phi$ is arc $\tan \{(L-R+SP)/(1+L+R)=$ where SP is the stereo presence signal, the system comprising in combination:

transmitter means for generating a single carrier frequency amplitude modulated in accordance with the algebraic addition of said first and second intelligence signals and phase modulated by an angle whose tangent is the ratio of the sum of the stereo presence signal and the difference between the first and second intelligence signals to the envelope of the amplitude modulated carrier; and receiver means capable of operating in either of two operational modes for receiving said carrier wave and for demodulating said first and second intelligence signals in quadrature for stereophonic operation and for detecting said stereo presence indicator signal for controlling the operational mode of the receiver means.

2. The communication system according to claim 1 wherein the receiver means further includes indicator means enabled by the detection of said stereo presence indicator signal.

3. A communication system according to claim 1 wherein the transmitter means further includes control means removing the stereo presence signal when the amplitude of the difference signal reaches a predetermined level.

4. A communication system according to claim 3 wherein the receiver means further includes gating means for controlling the operational mode of the receiver means in response to detection of one of the stereo presence signal and the difference signal.

5. A receiver for receiving a broadcast carrier wave which is amplitude modulated with signal information proportional to the sum of first (A) and second (B) intelligence signals and which is phase modulated by an angle $\phi$ having a form $\phi = \text{arc tan } C_1(A-B+SP)/(C_2+A+B)$ where $C_1$ and $C_2$ are constants and SP is the amplitude of a stereo presence indicator signal, the receiver comprising in combination:

means for selectively receiving the modulated carrier wave;

means for translating the received carrier wave to one of an intermediate frequency;

corrector circuitry for providing output signals which are substantially equal to the first and second intelligence signals;

detector means for detecting the stereo presence indicator signal;

switching means movable between first and second positions for enabling receiver operation in monophonic and stereophonic modes respectively in response to the detection of said stereophonic presence indicator signal.

6. The receiver according to claim 5 and further including an indicator means coupled for being enabled by the detection of the stereo presence indicator signal.

7. A receiver for receiving a compatible AM stereo signal including an infrasonic stereo presence signal having an amplitude SP, the received signal having the form $(1+L+R)\cos(\omega_c t+\phi)$ where L and R represent first and second intelligence signals, $\omega_c t$ is a carrier frequency and $\phi$ is arc tan $\{(L-R+SP)/(1+L+R)\}$ the receiver comprising in combination:

receiving means for providing an intermediate frequency signal in response to the received signal;

envelope detector means coupled to the receiving means for providing an output proportional to L+R;

synchronous detector means coupled to the receiving means for providing an output proportiona to $(L-R+SP)\cos\phi$;

corrector means for providing a correction signal proportional to $\cos\phi$;

divider means coupled to the synchronous detector means and to the corrector means for providing an output signal proportional to L−R+SP;

matrixing means coupled to the envelope detector means and to the divider means for providing signals proportional to L and R;

detector means for detecting the presence of the stereo presence signal; and switching means coupled to the detector means for switching the receiver mode in response to detection of the stereo presence signal.

8. The receiver in accordance with claim 5 and further including indicator means coupled to the detector means for providing indication of the presence of the stereo presence signal.

9. A receiver for receiving a compatible AM stereo signal amplitude modulated with 1+L+R and phase modulated with an angle $\phi = \text{arc tan } \{Q/(1+L+R)\}$ where L and R represent first and second intelligence signals and Q is alternatively (L−R) or SP where SP is the amplitude of an infrasonic stereo presence signal, the receiver including in combination:

receiving means for providing an intermediate frequency signal in response to the received signal;

envelope detector means coupled to the receiving means for providing an output proportional to L+R;

synchronous detector means coupled to the receiving means for providing an output proportional to $Q\cos\phi$;

corrector means for providing a correction signal proportional to $\cos\phi$;

divider means coupled to the synchronous detector means and to the corrector means for providing an output proportional to Q;

matrixing means coupled to the envelope detector means and to the divider means for providing signals proportional to L and R;

detector means for detecting the presence of the stereo presence signal;

gating means coupled to the divider means and to the stereo presence signal detector means for providing a control signal in response to the detection of one of the L−R and stereo presence signals; and switching means coupled to the detector means for switching the receiver mode in response to the control signal.

10. The receiver in accordance with claim 9 and further including indicator means coupled to provide indication of the presence of one of the stereo presence signal and the L−R signal.

* * * * *